United States Patent [19]

Magnusson

[11] Patent Number: 4,655,387

[45] **Date of Patent: * Apr. 7, 1987**

[54] PACKING CONTAINER PROVIDED WITH A SINE CURVE TEAR-UP OPENING ARRANGEMENT

[75] Inventor: Nils O. Magnusson, Löddeköpinge, Sweden

[73] Assignee: Tetra Pak International AB, Lund, Sweden

[ * ] Notice: The portion of the term of this patent subsequent to Oct. 18, 2000 has been disclaimed.

[21] Appl. No.: 808,366

[22] Filed: Dec. 13, 1985

Related U.S. Application Data

[63] Continuation of Ser. No. 575,767, Feb. 1, 1984, abandoned.

[30] Foreign Application Priority Data

Feb. 7, 1983 [SE] Sweden ..... 8300605

[51] Int. Cl.[4] ..... B65D 5/74

[52] U.S. Cl. ..... 229/17 R; 206/621; 206/625

[58] Field of Search ..... 229/17 R, 176; 206/621, 206/634, 625

[56] References Cited

U.S. PATENT DOCUMENTS

| | | | |
|---|---|---|---|
| 3,347,444 | 10/1967 | Rausing et al. | 229/17 R |
| 3,650,458 | 3/1972 | Rausing | 229/17 R |
| 3,795,359 | 3/1974 | Rausing | 229/7 R |
| 4,101,051 | 7/1978 | Reil | 229/17 R |
| 4,410,128 | 10/1983 | Rausing | 229/17 R |
| 4,527,732 | 7/1985 | Smith | 229/17 G |

*Primary Examiner*—William Price
*Assistant Examiner*—Bryon Gehman
*Attorney, Agent, or Firm*—Burns, Doane, Swecker & Mathis

[57] ABSTRACT

The invention relates to an opening arrangement for a package of the type which comprises a double-walled triangular lug (15) communicating with the interior of the package and being connected to one lateral edge (14) of the package and which comprises a sealing fin (10) extending over the top side (11) of the package and the said triangular lug (15). On both sides of the base line of the sealing fin (10) parallel tearing perforation lines (6) located opposite one another are provided which at a point on the top side of the triangular lug (15) converge uniformly in an arc-shaped manner so as to extend over the lateral edges (13) of the triangular lug (15) and converging on the underside of the triangular lug (15) without the said tearing perforation (6,6') having any breaks or point of discontinuity other than those arising in connection with the perforation (6') passing over the lateral edge (13) of the triangular lug (15).

1 Claim, 4 Drawing Figures

PACKING CONTAINER PROVIDED WITH A SINE CURVE TEAR-UP OPENING ARRANGEMENT

This application is a continuation of application Ser. No. 575,767, filed Feb. 1, 1984, now abandoned.

BACKGROUND OF THE INVENTION

The present invention relates to containers made of paper and plastic for liquids and, more particularly, to an opening arrangement for packages of the type which comprises a double-walled triangular lug communicating with the interior of the package and being connected to one side wall of the package, and a sealing fin extending over the top side of the package and the said triangular lug.

Packing containers of the above-mentioned type are frequently manufactured by converting a packing material web consisting of a carrier layer such as paper and surface layers of thermoplastic material such as polyethylene to a tube in which the longitudinal edges of the web are combined with one another in an overlapping joint. The formed tube is filled with the intended contents, for example, milk or fruit juice, whereupon the filled tube is flattened and sealed along narrow transverse regions of the tube so as to form closed packing containers cutting through the said transverse sealing zones separate the packages into individual containers, which containers are formed previously in special forming devices in connection with, or following, the sealing and separation into packing containers of the desired shape.

When a parallelepipedic shape is imparted to any one such tube section, triangular, double-walled lugs are formed at four opposite lateral edges. The interior of each lug communicates with the interior of the package, and these lugs are folded in and sealed to the packing container. During the division of the tube into individual packing containers which, as mentioned previously, is accomplished by cutting through the transversely sealed zones, upright sealing fins are formed which are relatively rigid, since doubled packing material is sealed together within this region. The said sealing fins which extend transversely over the tube will in the finished package extend transversely over the upper end wall of the package and over the top side of the triangular lugs up to their tip.

It has been known previously that on opening of the package these triangular lugs can be used to create a pouring duct, and in general this is realized so that one of the triangular lugs, which is lightly attached to the package body, is raised by breaking the sealed union, whereupon parts of the triangular lugs can be torn off so as to produce an emptying duct. Thus, it is known that underneath the base line of the sealing fin a perforation line can be arranged which either extends along a part of the sealing fin up to the tip of the fin or extends obliquely over the triangular lug as shown in the Swedish patent specification No. 213 171.

However, it has been found that these perforation configurations have certain disadvantages. It is difficult for example in the case of the straight perforation which extends along the base line of the sealing fin up to its tip to "initiate" the tear, since the tearing should start just at the tip of the triangular lug where several wall panels converge. Furthermore, the gripping part is relatively small to keep hold of during the tearing operation. It is a further disadvantage that the straight back perforation underneath the sealing fin only furnishes a linear opening which has to be widened by shaping the wall opening by hand. Although an oblique tearing perforation does of course provide a larger permanent pouring duct, in general the duct is of such a small length along the fin that no air can enter into the package during pouring which gives rise to the so-called gurgling phenomenon. A further disadvantage of the straight perforation is that the perforation line passes through the tip of the triangular lug, where the material is subjected to very great bending, tensile and shear stresses. As a consequence of these stresses, the perforation may open spontaneously, as when the package is exposed to a shock, which would result in a leakage.

Attempts have been made to combine the types of tearing perforation configurations mentioned above by providing a "broken" perforation line have not been successful. In the first place an oblique tearing perforation has to be initiated at an angle to the edge where the tearing starts which is more difficult than starting the tearing at a right angle to the said edge line. A second, and perhaps more decisive disadvantage is that the tearing which follows the oblique perforation in general continues straight along any break in the perforation line instead of being directed to the perforation which follows the sealing fin, that is to say it is not the whole opening that is torn open but only the oblique perforation which furnishes a small emptying duct giving rise to "gurgling" problems.

SUMMARY OF THE INVENTION

It has been found that any change in the tearing direction has to occur with very smooth transition and without points of discontinuity or breaks and the problem is solved in accordance with the invention in that on both sides of the base line of the sealing fin straight tearing perforation lines partly breaking through the packing material. These tearing perforation lines run parallel with one another up to a point situated at approximately half the distance between the tip of the triangular lug and its base line, at which point the straight perforation lines pass over into a continuous arc-shape on both sides of the fin being directed in continuing arc-shape over the edges of the triangular lug to meet at the underside of the triangular lug.

BRIEF DESCRIPTION OF THE DRAWINGS

A preferred embodiment of the invention will be described with reference to the enclosed drawing, wherein.

DETAILED DESCRIPTION OF THE PREFERRED EMBODIMENT

Figure 1:
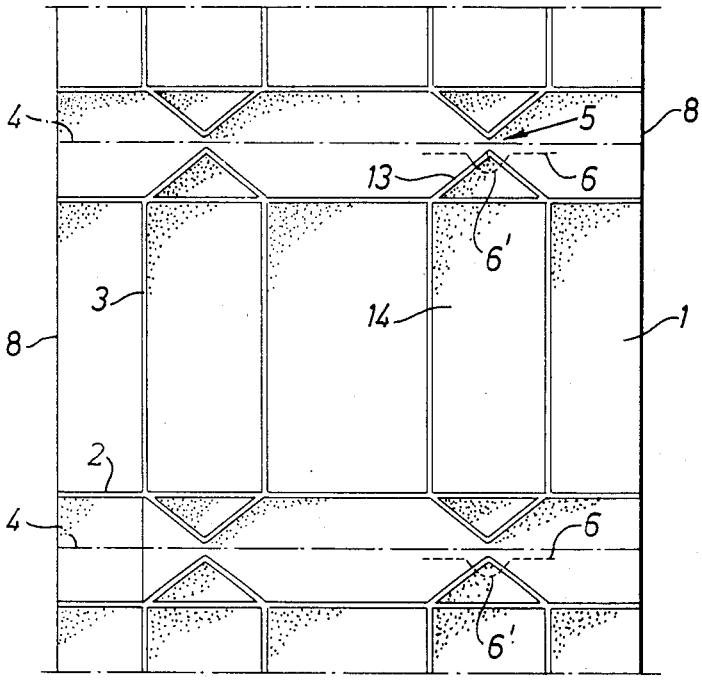
FIG. 1 is a plan view of a blank for a packing container.

The package in accordance with the invention is manufactured from a web 1 of packing material which is shown in FIG. 1. As is evident from the figure the web 1 is provided with crease lines 3 and 2, which facilitate the formation of folds in a repeating pattern. The web 1 consists of a carrier layer of paper or cardboard provided on both sides with layers of thermoplastic, preferably polyethylene, and in certain cases aluminium foil. The polyethylene layers have the double function of being sealing layers and watertight layers. The sealing is carried out by superimposing two plastic layers while they are heated to melting and simultaneously compressed. This sealing process causes the plastic layers to fuse together so as to form a tight and mechanically durable sealing join.

Figure 2:
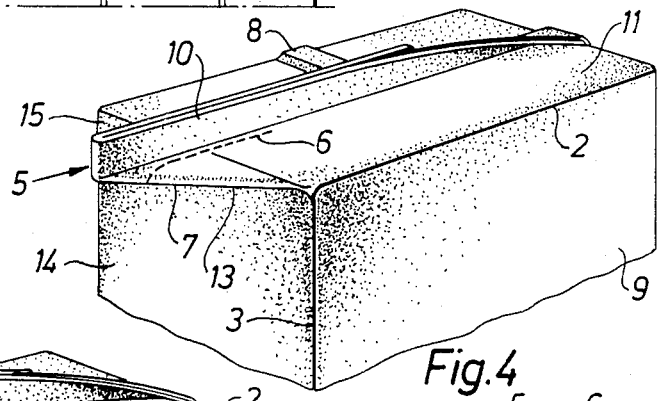
FIG. 2 is a perspective view of the upper part of a packing container.
Figure 3:
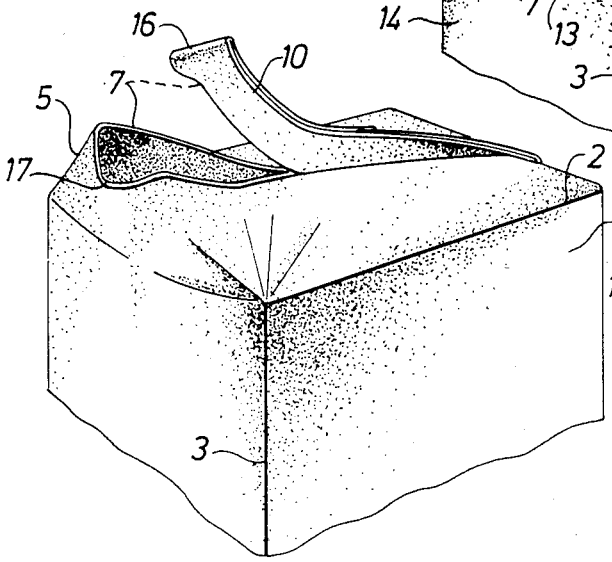
FIG. 3 is a perspective view of the packing container of FIG. 2 after it has been opened.

The manufacture of the package is started by continuous turning of the web 1 into a tube while the tube is rolled off of a magazine roll. The tube is formed such that the longitudinal edge zones 8 of the web are joined to one another in an overlapping joint, whereupon the tube formed is filled with the intended contents and then flattened along narrow sealing regions transverse to the tube. The interior thermoplastic layers of the tube are sealed to one another through the supply of heat and pressure. As a result a certain quantity of contents is enclosed between two successive transverse seals of the tube. Simultaneously with, or following, the sealing of the tube, the packing material is form-processed by folding along the crease lines 3,2 in order to form a parallelepipedic package of the type whose upper part is shown in FIGS. 2 and 3. The formed packing containers are separated from the rest of the tube by means of cuts through the transverse sealing zones 4, as shown in FIG. 1. As mentioned previously, double-walled triangular lugs 15 are produced in the fold-forming process which can be raised up in the manner as shown in FIG. 2 to be level with the top side 11 of the packing container or else they can be dropped down and sealed against the side wall 14 of the package. As is evident from FIG. 1, a tearing perforation 6 is provided in the vicinity of the tip 5 of the crease line 13, in order to facilitate the folding of the triangular lug. The tearing perforation 6 is arranged directly underneath the region 4 within which the formed tube is flattened and sealed. After the sealed package has been separated from the tube, an upright sealing fin 10 of the type which is shown in FIG. 2 is formed. is evident from FIG. 2 that the said tearing perforation 6 is located close to the base line of the sealing fin 10 and that the perforation 6 extends along the sealing fin 10 up to a point in the centre of the triangular lug 15 where the perforation line 6 deviates outward from the sealing fin to pass the edge 7 of the triangular lug 15 and continue on the underside of the triangular lug.

Figure 4:
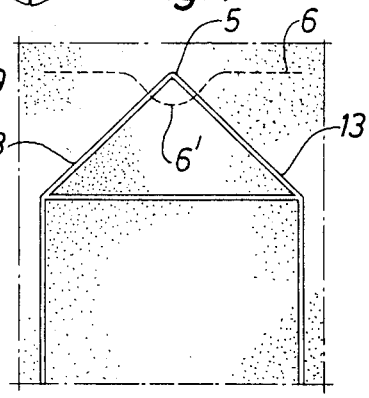
FIG. 4 is an enlarged view of a portion of the blank shown in FIG. 1.

As is evident from FIG. 4, the tearing perforation line 6 consists of two straight segments connected by a curved perforation part 6'. The curved part 6' preferably constitutes a whole period of a sine curve, the maximum points of the sine curve coinciding with the points where the straight perforation line 6 is joined whereas the minimum point of the sine curve is located directly beneath the tip 5 of the triangular lug. As is also evident from FIG. 4, the curved or arc-shaped perforation part 6' will cross the crease line 13 at a right angle which has been found to be a great advantage when the tearing indication is to be broken up, inasmuch as initiation of the tearing will take place at a right angle to the tearing edge. Opening of the package is accomplished by raising the triangular lug 15 and then pressing the lug inward by bringing the crease lines 13 toward each other at the same time as the lug is clasped from the side so that it lies level with the sealing fin 10. When compression of the lug has been carried out the front edge of the sealing fin 10 can be gripped easily between the fingers at the same time as a tearing has been initiated. Tearing follows the arc-shaped perforation 6' to pass over smoothly into the straight part of the perforation 6.

Owing to the arc-shaped part of the perforation 6' being designed as a sine curve, an optimum tearing initiation is obtained in that the tearing is started in a right-angled direction to the edge of the pressed down triangular lug 15 and in that the tearing passes over in the smoothest possible manner into the straight part of the perforation 6. A smooth tearing transition is desired, for it has been found that a break or point of discontinuity in the transition to the straight part of the perforation often gives rise to tearing that does not pass into the straight part of the perforation but continues in the packing material up through the sealing fin 10.

FIG. 3 shows what the package looks like after it has been opened and as is evident from the figure, the enlarged grip portion 16 at the front part of the sealing fin 10 is clearly visible. This enlarged grip portion facilitates the tearing process. Moreover, a natural pouring duct 17 is formed which to a certain degree facilitates the pouring out of the contents from the packing container.

I claim:

1. A folded paper carton having a parallelpipedic shape comprising a top side, a double-walled triangular lug formed along one edge of said top side and adapted to be folded along said one edge to position the underside of the lug against a side wall of the carton, said lug communicating with the interior of the carton, and being connected to the side wall of the carton, a sealing fin extending from an apex of the lug across the lug and the top side of the carton, the improvement comprising an opening arrangement including a perforation line extending on both sides of a base line of the sealing fin, said perforation line having a pair of straight segments running parallel with one another up to a point situated at approximately half the distance between the tip of the triangular lug and a base line of the lug, each of said pair of straight segments having two straight parts joined together by an arc-shaped part in the absence of any point of discontinuity or break along the perforation line, said perforation line having the continuous arc-shape segment interconnecting said straight segments on both sides of the fin a continuous arc-shape over the edges of the triangular lug at substantially right angles to the edges of the triangular lug, the arc-shaped segment of the perforation line being a whole period of a sine curve, the curve having maximum points where the straight segments of the perforation are joined and a minimum point located on the underside of the triangular lug along a line located in a plane through the sealing fin when in a raised position, said perforation line, upon tearing open the package, crossing the edges of the triangular lug at right angles and providing an enlarged grip portion.

* * * * *